United States Patent [19]

Roos

[11] 4,413,428

[45] Nov. 8, 1983

[54] HAIR DRYER CASING

[75] Inventor: Johannes P. Roos, Medemblik, Netherlands

[73] Assignee: Indola Cosmetics B.V., Rijswijk, Netherlands

[21] Appl. No.: 871,085

[22] Filed: Jan. 19, 1978

[30] Foreign Application Priority Data

Jan. 21, 1977 [NL] Netherlands .....7700652
Jan. 21, 1977 [NL] Netherlands .....7700654

[51] Int. Cl.[3] ..... A45D 20/22

[52] U.S. Cl. ..... 34/100; 34/82; 219/367

[58] Field of Search ..... 34/97, 243, 98, 99, 34/100, 82; 219/360, 366, 367, 369, 370, 371, 373; D28/12, 16, 17

[56] References Cited

U.S. PATENT DOCUMENTS

| | | | |
|---|---|---|---|
| 1,982,255 | 11/1934 | Knoll | 34/82 |
| 2,013,572 | 9/1935 | McCord | 219/366 |
| 3,052,038 | 9/1962 | Harris | 34/100 X |
| 3,430,353 | 3/1969 | Selinger | 34/100 |
| 3,775,861 | 12/1973 | Waters et al. | 34/99 |

FOREIGN PATENT DOCUMENTS

| | | | |
|---|---|---|---|
| 206915 | 2/1909 | Fed. Rep. of Germany | 34/82 |
| 343481 | 2/1931 | United Kingdom . | |
| 882473 | 11/1961 | United Kingdom | 34/99 |
| 1037098 | 7/1966 | United Kingdom . | |
| 1145145 | 3/1969 | United Kingdom | 34/99 |

*Primary Examiner*—William E. Wayner
*Assistant Examiner*—Harold Joyce

[57] ABSTRACT

A hair dryer apparatus includes a casing in which an inner space is provided for receiving the head of the person whose hair is to be dried. A support member, which includes a motor-driven fan and a heating element, further includes a bow-shaped member which includes means for directly pivotally connecting the bow-shaped member to the casing.

1 Claim, 2 Drawing Figures

HAIR DRYER CASING

Figure 1:
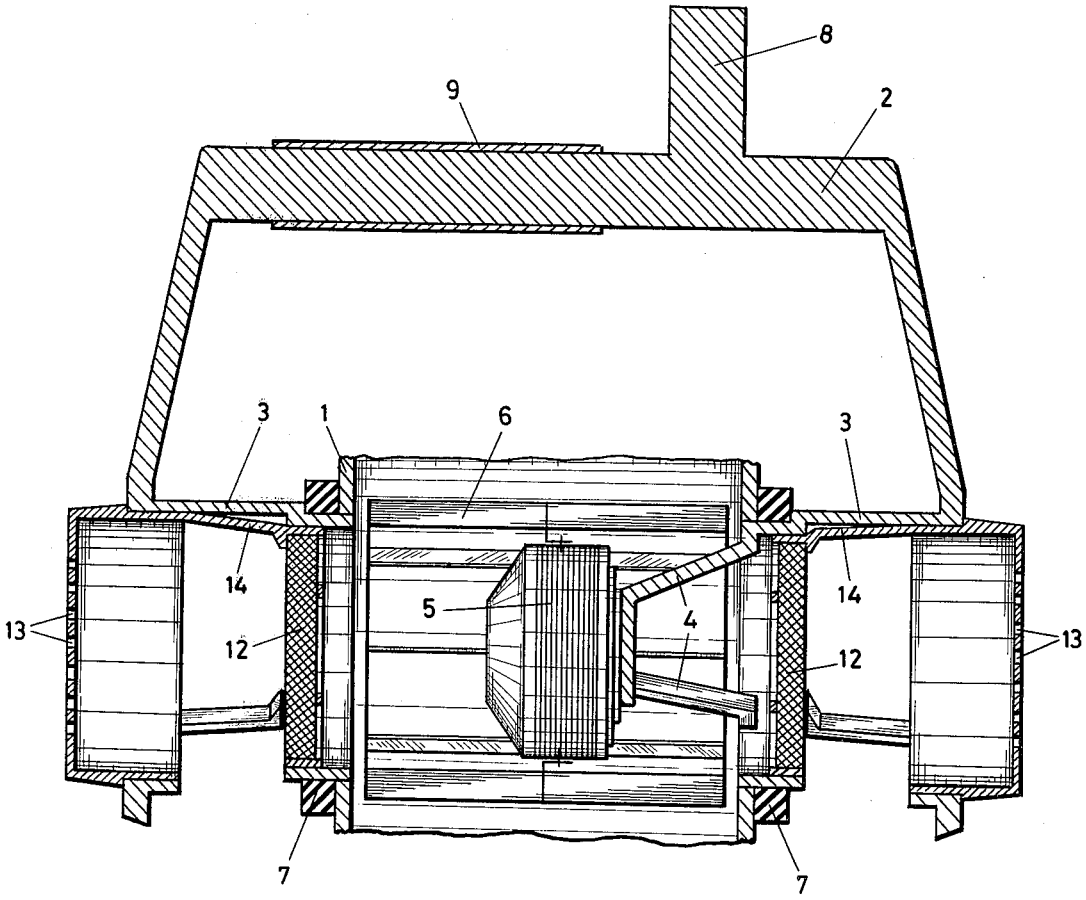

The invention relates to a hair dryer casing including a double wall the inner wall of which is provided with apertures for passing air blown by a motor-fan-combination in the space between both walls and a bow for supporting the casing. A hair dryer casing of this type is conventionally made of a light-weight material since the motor-fan-combination represents a heavy part of the casing. The conventional support or suspension of the casing has the disadvantage in that it requires that a choice be made between either an unfavorably positioned hinge-point of the support means or a weight compensation.

It is an object of the invention to provide a hair dryer casing of the above-mentioned type in which this disadvantage has been removed. According to the invention this is obtained by fixing the bow to the center line of the motor-fan combination being performed as a radial blower having a drum fan. A result of this novel arrangement is that, independent of the position of the hinge points the weight of the motor-fan combination rests directly on the hinge points, such that the installation of the upright stand has a favorable overturning angle and the "opening" will lead to a more simple construction of the casing per se.

In this arrangement it is not necessary to rotate the casing including the motor around the hinge point; in the hair dryer casing according to the invention it is only the casing which rotates around the hinge points since the motor is supported by the hinge points. The hinge points of the motor-fan as well as the bow are near a point of the almost elliptical horizontal cross section of the casing. This leads to the advantage that the casing can rotate under the bow so that the bow can be present either at the upperside of the casing or at the underside, which is suitable in view of the suspension to a wall or positioning on an upright stand.

By using a radial blower having a drum fan for the motor-fan combination the hair of the preson to be treated can be uniformly dried in a manner which also provides for quick drying. By the use of a radial blower having a drum fan a certain power will lead to a much greater air pressure in the space between the two casing walls as compared to the use of a conventional radial fan. Further, a radial blower having a drum fan has the advantage of producing much lower noise during operation. It is apparent that the advantages obtained by the present invention will be highly pleasing to the person to be treated by the hair dryer.

According to a perferred embodiment of the invention each bow end is in the shape of a tube extending perpendicular to the bow leg and the motor-fan combination is secured between both tubes. In this embodiment the casing surrounds both tubes outwardly coaxially.

In a hair dryer casing in which filters are used for the air to be supplied to the casing, the air is sucked through the tubes in the bow ends in which the filters have been positioned.

In order to increase the comfort of the person to be treated according to another characterizing feature of the invention, the apertures in the casing inner wall are not spread uniformly over the inner wall. The parts of the inner wall of the hair dryer casing which are to be placed adjacent head portions that have no hair, for instance the ears, are not provided with such apertures.

According to another characterizing feature of the invention the apertures or of the same size. The aperture size can be tuned to the thickness of the adjacent hair layer, such that all the hair of a person will reach the required dryness at almost the same time.

In order to keep the supplied power as low as possible, and thereby increase the efficiency of the hair dryer, recirculation is used in the hairdryer casings. That is, after it passes the hair a portion of the air being blown in the casing is sucked back through special apertures in order to be heated again and blown again into the casing. In this case the fresh air blown in the casing is composed of a portion of fresh air and a portion of recirculated air.

In a hair dryer casing according to the invention the interior space of the bow tube and the air space in the casing are connected to each other by a canal running from the tube wall at the filter side remote from the fan to the adjacent casing wall. By this measure, the fresh air and the recirculating air are mixed before passing through the filters. By this effect, the interior of the casing will pollute only slowly and the unpleasant smell caused by burning dirt deposited on the means will be reduced to a minimum.

Figure 2:
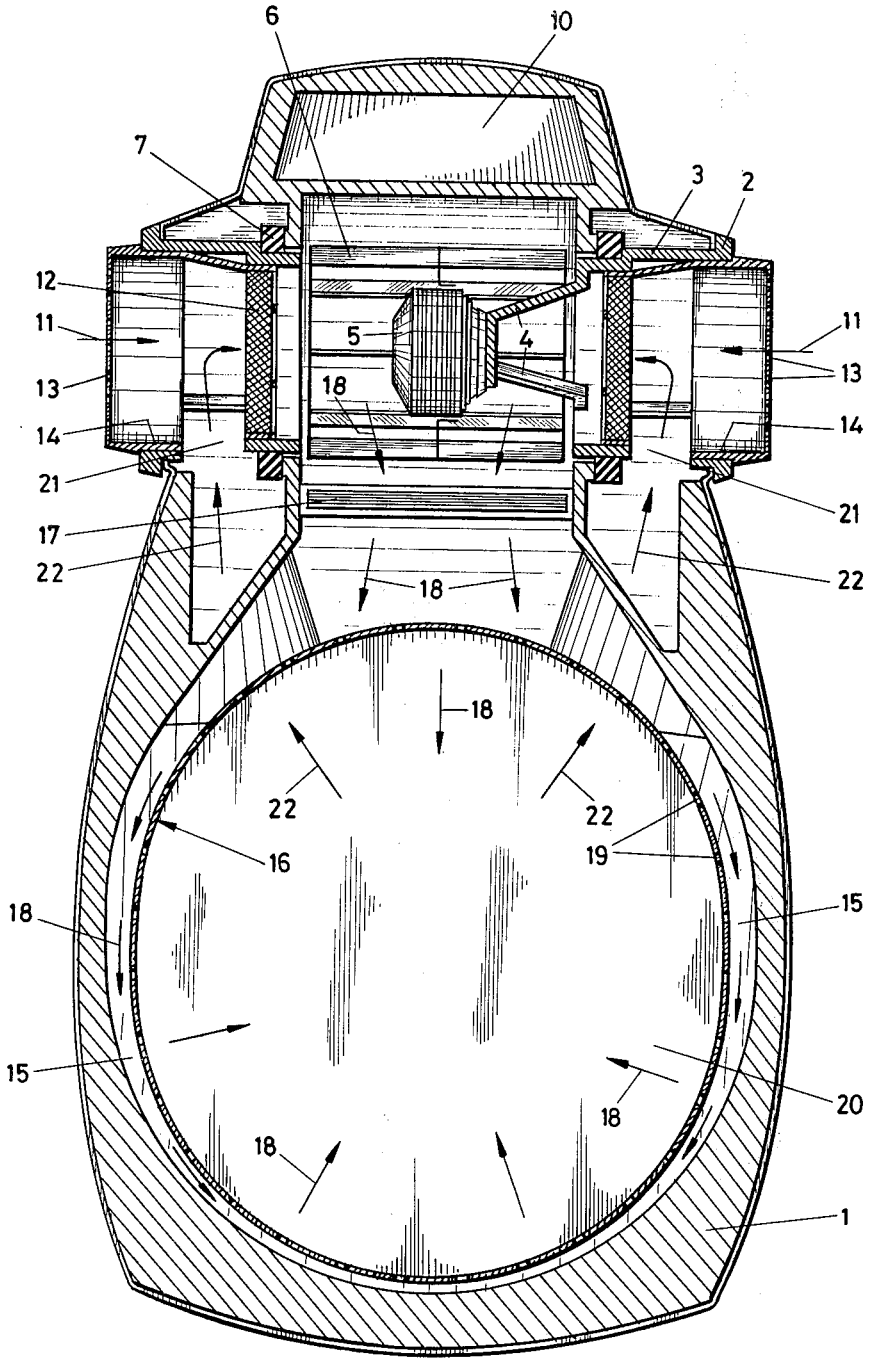

The foregoing and other operating and constructional features and advantages of the invention are shown and described in detail in connection with the accompanying drawing in which:

FIG. 1 is a cross section of a hair dryer casing according to the invention at the height of the bow; and FIG. 2 is a cross section perpendicular to the section shown in to FIG. 1 of the hair dryer casing according to the invention.

Referring to the drawings a hair dryer casing 1 is suspended hingedly in a bow 2. The leg ends of the bow 2 are in the shape of a tube 3 perpendicular to the leg trend. The motor 5 of the fan 6 is fixed to a projection 4 of one of said tubes 3. The casing 1 surrounds the tubes 3 outwardly; tightening means 7 are present between the casing 1 and the tubes 3. Bow 2 can be provided with a projection 8 and a rough means 9 preferably of plastic to provide a suitable handle. Casing 1 can be rotated or swung so that portion 10 of the casing 1 passes under bow 2 so that bow 2 can be present above or below casing 1 for suspending the hair dryer casing to a wall or positioning said casing on an upright stand.

Fresh air is sucked through tube 3 (see arrows 11). In order to purify the fresh air each tube is provided with a filter 12. Large-sized impurities carried along by the air are prevented from entering by means of a perforated closing means 13. Closing means 13 is removably brought into the tube 3 for changing filter 12. In a preferred embodiment according to the invention filter 12 is positioned in a cup-shaped closing unit 14 the bottom 13 of which is perforated. Unit 14 fits suitably in tube 3.

The air sucked in through tubes 3 and filters 12 by the fan 6 is directed through a heating means 17 to space 15 between casing 1 and through perforations 19 in inner wall 16. (see arrows 18) to the interior 20 of casing 1 which surrounds the head of the person to be treated.

The apertures 19 in the inner wall 16 are not spread uniformly over the inner wall. The portions of the inner wall of the hair dryer casing, which are to be positioned adjacent the portions of the person's head that have no hair, for instance the ears, are also not provided with apertures. Further the aperture size can be directed to the thickness of the adjacent hair layer. Consequently all of the person's hair to be treated reaches the required dryness at almost the same time.

In order to keep the used power as low as possible recirculation is used. That is, after passage of the head hair to be treated, a part of the air blown into the casing interior space 20 is sucked back to the fresh-air input, is heated again, and is blown again into the casing. To that end a canal 21 is present between each tube 3 and adjacent the casing wall. The air of the interior space 20 of casing 1 can run according to arrow 22 through channel 21 to tubes 3 where the air is mixed with fresh air and runs through filters 12 and heating means 17 back into the space between casing 1 and inner wall 16.

What is claimed is:

1. A hair drying apparatus of the type comprising a double-walled casing having an outer wall and a perforated inner wall separated by an intermediate space from the outer wall and partly enclosing an inner space for receiving the head of a person whose hair is to be dried, a supporting member pivotally connected to said casing and means, including a motor-driven fan and air-heating means, for producing a flow of heated air into said intermediate space and through the perforations of said inner wall into said inner space where, in use, it will impinge on the hair to be dried, said supporting member comprising a bow-shaped member having tubular end parts which are axially aligned with each other and disposed substantially perpendicularly to the parts of said casing adjoining said bow-shaped member, said bow shaped-member including pivot means for directly pivotally connecting the tubular end parts of said bow-shaped member to said casing so that said casing is pivotally adjustable about only one axis coincident with the center-line of the motor-driven fan, said motor-driven fan being fixed to said bow-shaped member so as to be supported thereby in a position between the tubular end parts, said motor-driven fan having a drum-shaped rotor which operates as a radial blower so as to draw air from the outside of the double-walled casing through the tubular end parts of the bow-shaped members, said tubular end parts being provided with filters which are positioned in the axial inner end of each of said tubular end parts for filtering the air drawn in through the same, and said inner space which is partly enclosed by said inner wall of said double-walled casing being connected through openings in the walls of the tubular end parts with those portions of the interiors of said tubular end parts which are located on that side of the respective filter which is remote from the fan, so that, in use, the fan will draw not only fresh air from outside the casing, but also recirculated air from said inner space for delivery through the filters into the intermediate space between the walls of the double-walled casing.

* * * * *